US007199512B2

(12) United States Patent
Park et al.

(10) Patent No.: US 7,199,512 B2
(45) Date of Patent: Apr. 3, 2007

(54) COLOR CATHODE RAY TUBE

(75) Inventors: Sang Yoon Park, Gumi-si (KR); Jong Eon Choi, Gumi-si (KR); Pyeong Soo Jeong, Daegukwangyeok-si (KR)

(73) Assignee: LG. Philips Displays Korea Co., Ltd., Gumi-Si (KR)

( * ) Notice: Subject to any disclaimer, the term of this patent is extended or adjusted under 35 U.S.C. 154(b) by 0 days.

(21) Appl. No.: 10/855,398

(22) Filed: May 28, 2004

(65) Prior Publication Data

US 2005/0057139 A1 Mar. 17, 2005

(30) Foreign Application Priority Data

Sep. 17, 2003 (KR) ..... 10-2003-0064599
Nov. 21, 2003 (KR) ..... 10-2003-0082848

(51) Int. Cl.
*H01J 29/80* (2006.01)

(52) U.S. Cl. ..... 313/402; 313/407

(58) Field of Classification Search ..... 313/402–408
See application file for complete search history.

(56) References Cited

U.S. PATENT DOCUMENTS

| | | | | |
|---|---|---|---|---|
| 5,233,266 | A * | 8/1993 | Spina et al. | 313/402 |
| 6,559,585 | B2 * | 5/2003 | Murai et al. | 313/402 |
| 6,664,724 | B2 * | 12/2003 | Lim | 313/402 |
| 6,909,227 | B2 * | 6/2005 | Park et al. | 313/402 |
| 2001/0011864 | A1 * | 8/2001 | Nose et al. | 313/407 |

* cited by examiner

*Primary Examiner*—Mariceli Santiago
*Assistant Examiner*—Anne M Hines
(74) *Attorney, Agent, or Firm*—Birch, Stewart, Kolasch & Birch, LLP

(57) ABSTRACT

The present invention relates to a color cathode ray tube in which beam landing errors caused by non-uniform thermal expansion of a shadow mask are corrected such that color purity is improved. In one aspect of the present invention, a color cathode ray tube comprises a panel on inner surface of which a phosphor screen is formed; a funnel joined to the panel; an electron gun; a shadow mask mounted to the panel, the shadow mask having a faceplate portion and a peripheral skirt portion bent back from the faceplate portion; and a frame joined to said shadow mask; wherein radius of curvature of at least a corner of the faceplate portion of said shadow mask is not smaller than 50 mm, and gap is provided between a corner of the faceplate portion of said shadow mask and a corresponding corner of said frame.

24 Claims, 10 Drawing Sheets

COLOR CATHODE RAY TUBE

This Non-provisional application claims priority under 35 U.S.C. § 119(a) on Patent Application No(s). 10-2003-0064599 and 10-2003-0082848 filed in Korea on Sep. 17, 2003 and Nov. 21, 2003, respectively, the entire contents of which are hereby incorporated by reference.

TECHNICAL FIELD

The present invention relates to a color cathode ray tube and more specifically to a color cathode ray tube in which beam landing errors caused by non-uniform thermal expansion of a shadow mask are corrected such that color purity is improved.

BACKGROUND OF THE INVENTION

FIG. 1 shows a schematic diagram illustrating the structure of a general color cathode ray tube. As shown in FIG. 1, the color cathode ray tube generally includes a glass envelope having a shape of bulb and being comprised of a faceplate panel 10, a tubular neck, and a funnel 20 connecting the panel 10 and the neck.

The panel 10 comprises faceplate portion and peripheral sidewall portion sealed to the funnel 20. A phosphor screen 30 is formed on the inner surface of the faceplate portion. The phosphor screen 30 is coated by phosphor materials of R, G, and B. A multi-apertured color selection electrode, i.e., shadow mask 40 is mounted to the screen with a predetermined space. The shadow mask 40 is hold by a peripheral frame 70. An electron gun 50 is mounted within the neck to generate and direct electron beams 60 along paths through the mask to the screen.

The shadow mask 40 and the frame 70 constitute a mask-frame assembly. The mask-frame assembly is joined to the panel 10 by means of springs 80.

The cathode ray tube further comprises an inner shield 90 for shielding the tube from external geomagnetism, a reinforcing band attached to the sidewall portion of the panel 10 to prevent the cathode ray tube from being exploded by external shock, and external deflection yokes 110 located in the vicinity of the funnel-to-neck junction.

The electron beams generated by the electron guns are deflected in both vertical and horizontal directions by the deflection yokes 110. The electron beams are selected depending on the colors by the shadow mask and impinge on the phosphor screen such that the phosphor screen emits light in different colors. Typically, about 80% of the electrons from the electron guns 50 fail to pass through the apertures of the shadow mask 40. The 80% electrons impinge upon the shadow mask 40, producing heat and raising temperature of the mask 40.

FIG. 2 shows a perspective view of a quarter of a shadow mask illustrating thermal distribution of the surface of the mask due to the impingement of electrons. As shown in FIG. 2, temperature of the mask is different for different portion of the mask. In FIG. 2, center portion of the mask has higher temperature than corner portion. The reason why the corner portion has lower temperature is that the heat at the corner portion is dissipated through the frame attached to the mask. Since the frame is attached to the mask at the skirt portion near the corner, heat at the corner is easily transferred to outside via the frame. Because the mask is thermally expanded, position of the apertures at the shadow mask is accordingly shifted from the desired position. Therefore, electron beams passing through the apertures land at the screen incorrectly. In this way the color purity at the screen is degraded. This phenomenon of purity degradation resulting from the undesired positional shift of the apertures of the mask is called the "doming effect."

FIG. 3*a* shows cross sectional view of the shadow mask for illustrating purity degradation resulting from the positional shift of the apertures of the shadow mask 40. FIG. 3*b* shows a graph showing variation of extent of positional shift of electrons landing incorrectly at the screen with respect to time after the cathode ray tube is operated.

As shown in FIG. 3*a*, electron beam landing at the screen is shifted due to the positional shift of the apertures of the shadow mask. As shown in FIG. 3*b*, the extent of the shift of the electron landing at the screen increases just after when the cathode ray tube is operated, since the temperature of the shadow mask increases. However, as heat at the shadow mask is transferred to the frame, the frame is heated and expanded. Accordingly, the positional shift of the electron landing is decreased. As the heat dissipation through the frame continues, the landing position of the electron beam is varied to the opposite direction with respect to the initial shift just after the operation of the shadow mask.

The variation of the shift of the electron beam landing causes degradation of color purity. Further, since landing position varies in accordance with the time after the shadow mask is operated, correction work of the aperture position with respect to the screen becomes difficult.

FIG. 4 shows a perspective view of the conventional shadow mask. As shown in FIG. 4, radius of curvature of corners of faceplate of the shadow mask 40 is from 5 mm through 20 mm. Since the curvature of corners is small, the shadow mask is strong against deformation. Also, small radius of curvature of corners acts to hinder thermal expansion of corner of the shadow mask when the mask expands from temperature elevation. The small expansion of the corner in comparison with other portion, causes overall non-uniformity of thermal expansion. The non-uniform expansion of mask results in the doming effect and, accordingly, degradation of color purity.

Also, improvement of the material used for the shadow mask was suggested. Invar material having low thermal expansion rate was used for the shadow mask instead of aluminum-killed steel (AK) material. However, the result of using the invar material was not so satisfactory in view of the price of the material.

SUMMARY OF THE INVENTION

An object of the present invention is to provide a color cathode ray tube where landing error problem causing degradation of color purity is prevented.

Another object of the present invention is to provide a color cathode ray tube where overall cost for making a shadow mask is reduced.

According to an aspect of the present invention, a color cathode ray tube comprises a panel on inner surface of which a phosphor screen is formed; a funnel joined to the panel; an electron gun generating electron beams; a shadow mask mounted to the panel, the shadow mask having a faceplate portion and a peripheral skirt portion bent back from the faceplate portion; and a frame joined to said shadow mask; wherein radius of curvature of at least a corner of the faceplate of said shadow mask is not smaller than 50 mm, and gap is provided between a corner of the faceplate portion of said shadow mask and a corresponding corner of said frame.

According to another aspect of the present invention, a color cathode ray tube comprises a panel on inner surface of which a phosphor screen is formed; a funnel joined to the panel; an electron gun generating electron beams; a shadow mask mounted to the panel, the shadow mask having a faceplate portion and a peripheral skirt portion bent back from the faceplate portion; and a frame joined to said shadow mask; wherein at least a corner of the faceplate portion of said shadow mask includes substantially straight line portion, and gap is provided between a corner of the faceplate portion of said shadow mask and a corresponding corner of said frame.

According to other aspect of the present invention, a color cathode ray tube comprises a panel on inner surface of which a phosphor screen is formed; a funnel joined to the panel; an electron gun generating electron beams; a shadow mask mounted to the panel, the shadow mask having a faceplate portion and a peripheral skirt portion bent back from the faceplate portion; and a frame joined to said shadow mask; wherein at least a corner of the faceplate portion includes a concave portion, and gap is provided between a corner of the faceplate portion of said shadow mask and a corresponding corner of said frame.

DETAILED DESCRIPTION

Preferred embodiments of the present invention will be described in a more detailed manner with reference to the drawings.

<Embodiment 1>

According to an aspect of the present invention, a color cathode ray tube comprises a panel on inner surface of which a phosphor screen is formed; a funnel joined to the panel; an electron gun generating electron beams; a shadow mask mounted to the panel, the shadow mask having a faceplate portion and a peripheral skirt portion bent back from the faceplate portion; and a frame joined to said shadow mask; wherein radius of curvature of at least a corner of the faceplate portion of said shadow mask is not smaller than 50 mm, and gap is provided between a corner of the faceplate portion of said shadow mask and a corresponding corner of said frame.

Figure 1:
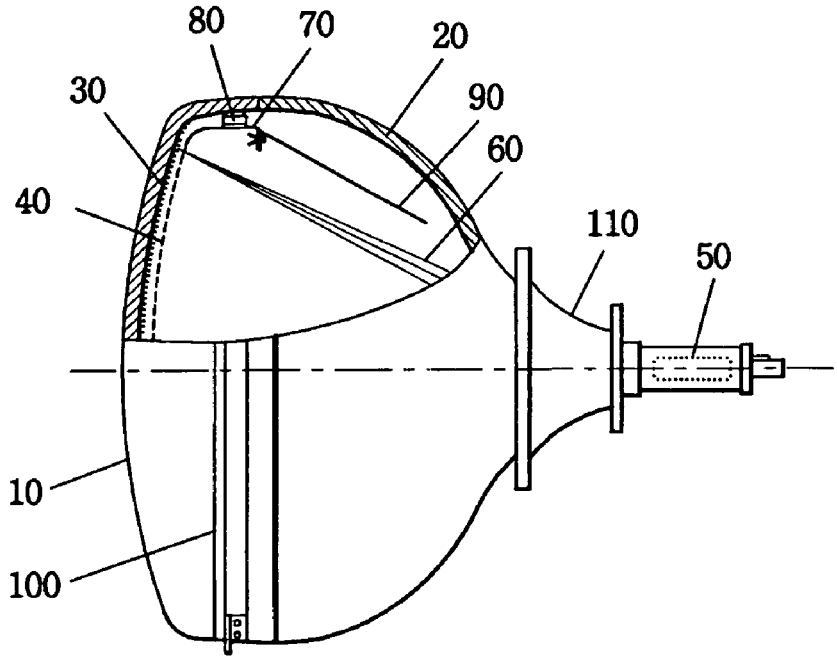
Fig. 1 (Related Art)
FIG. 1 shows a schematic diagram illustrating the structure of a general color cathode ray tube.
Figure 2:
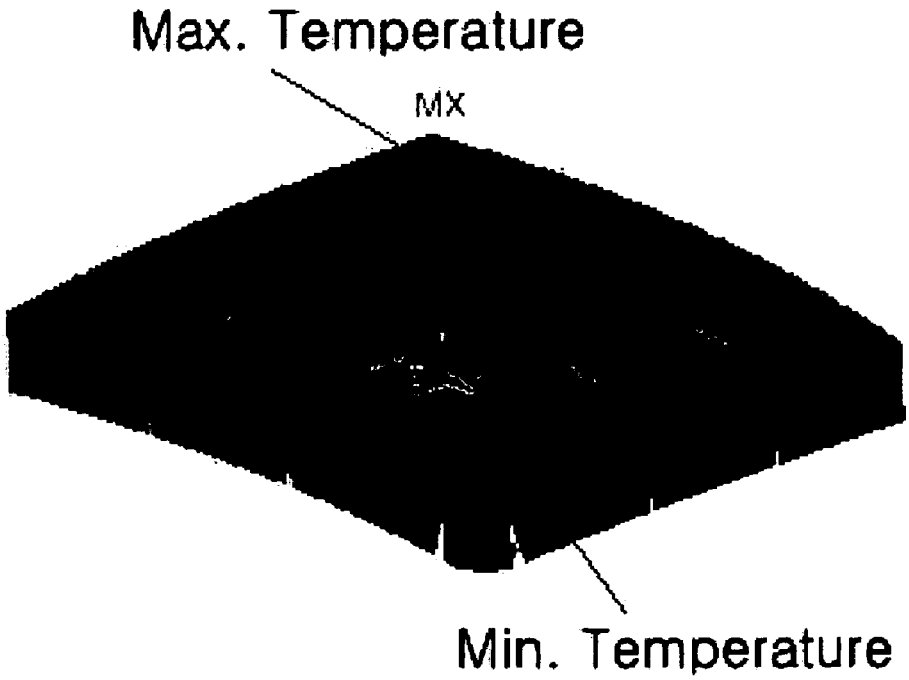
Fig. 2 (Related Art)
FIG. 2 shows a perspective view of a quarter of a shadow mask illustrating thermal distribution of the surface of the mask due to the impingement of electrons.
Figure 3A:
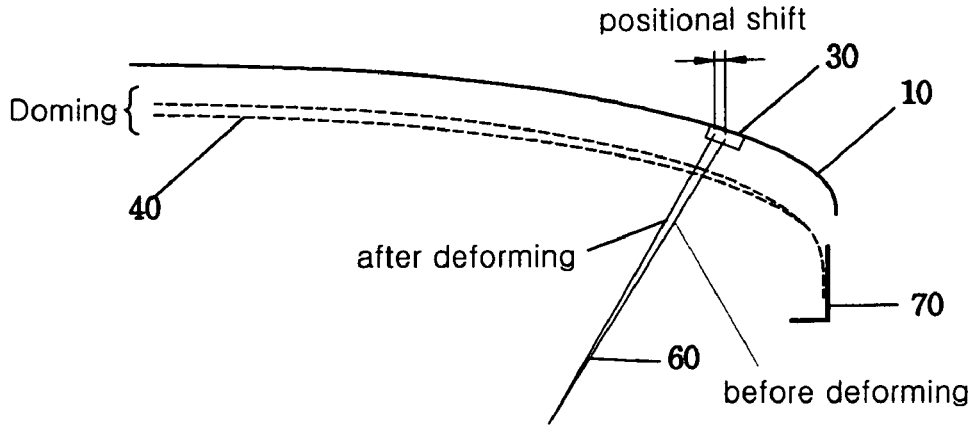
Fig. 3a (Related Art)
FIG. 3*a* shows cross sectional view of the shadow mask for illustrating purity degradation resulting from the positional shift of the apertures of the shadow mask.
Figure 3B:
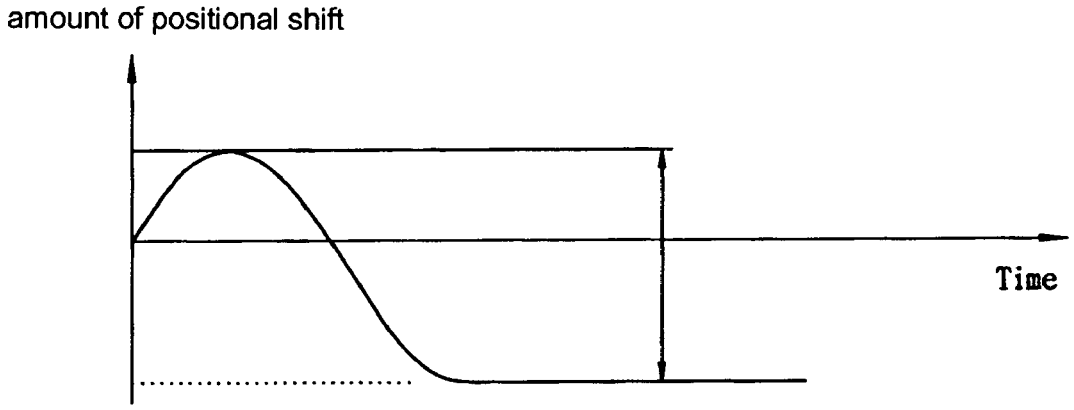
Fig. 3b (Related Art)
FIG. 3*b* shows a graph showing variation of amount of positional shift of electrons landing incorrectly at the screen with respect to time after the cathode ray tube is operated.
Figure 4:
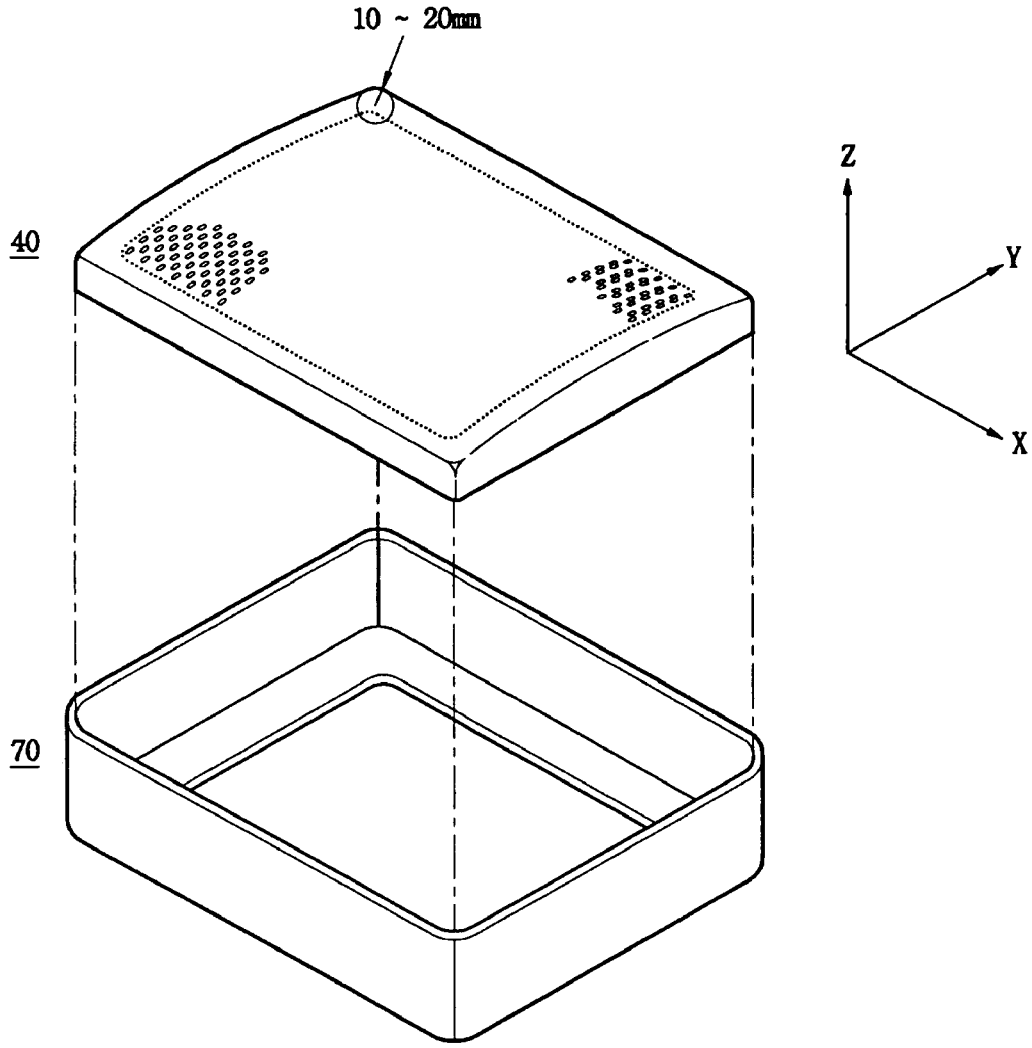
Fig. 4 (Related Art)
FIG. 4 shows a perspective view of the conventional shadow mask.
Figure 5:
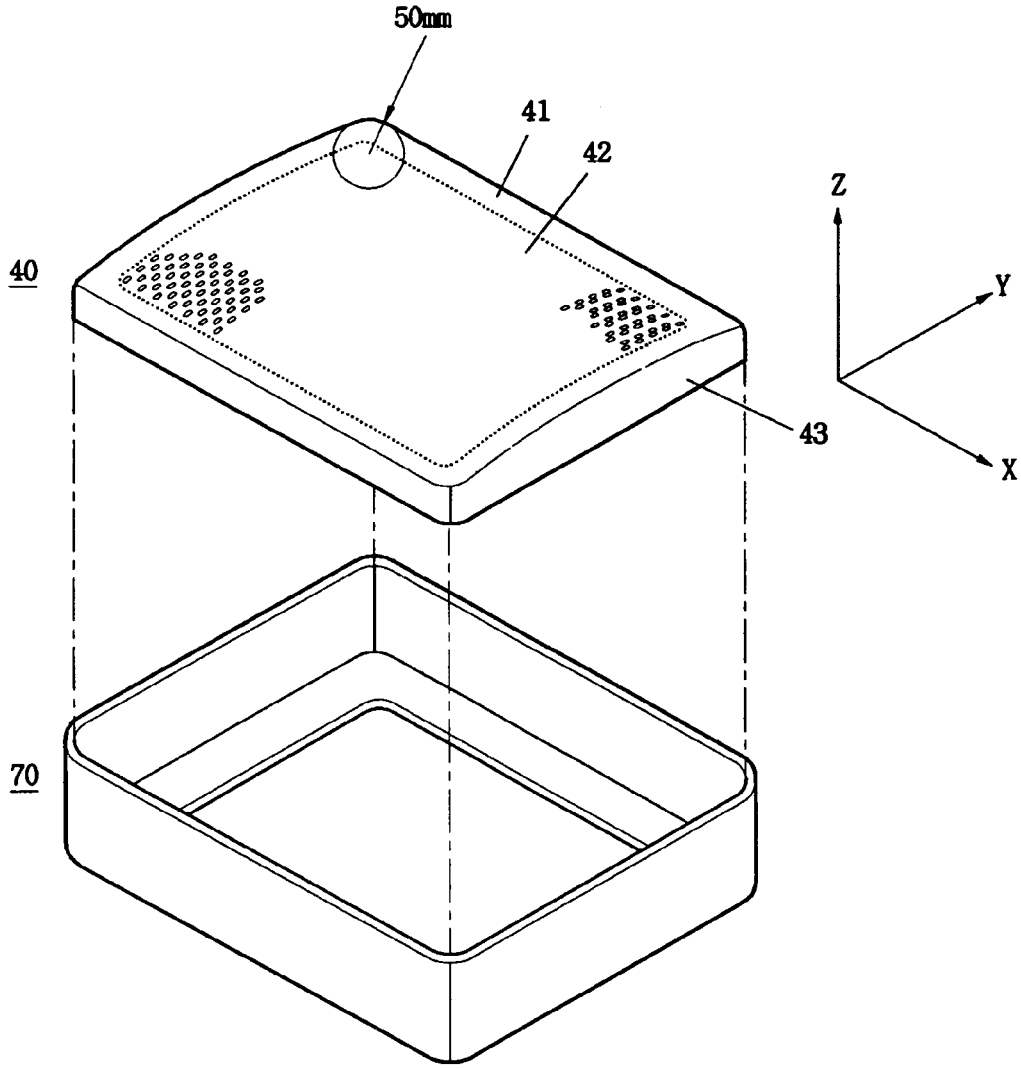
FIG. 5 shows a perspective view of the shadow mask in accordance with Embodiment 1 of the present invention.

FIG. 5 shows a perspective view of the shadow mask in accordance with Embodiment 1 of the present invention.

As shown in FIG. 5, the shadow mask in accordance with Embodiment 1 of the present invention comprises a faceplate portion and a peripheral skirt portion 43 bent back from the faceplate portion and extending backward from the faceplate portion. The faceplate portion further comprises an apertured portion 42 where minute apertures through which electron beams pass are defined and a non-apertured border portion 41 surrounding the apertured portion 42.

The shadow mask 40 is held by a peripheral frame 70 which is joined to the skirt portion of the mask. Hereinafter, larger sides of the rectangular faceplate, which are parallel to X axis of FIG. 5, are called long sides. On the other hand, smaller sides of the rectangular faceplate, which are parallel to Y axis, are called short sides.

According to Embodiment 1, radius of curvature of at least a corner of the faceplate of the shadow mask is designed to have a large value in comparison with the prior art.

By enlarging the radius of curvature of a corner of the faceplate of the shadow mask, it is possible to provide gap between the corner of the faceplate of the shadow mask and the corresponding corner of the frame.

The inventor carried out experiments on doming effect while enlarging the radius of curvature of corners of the faceplate of the shadow mask.

Figure 7:
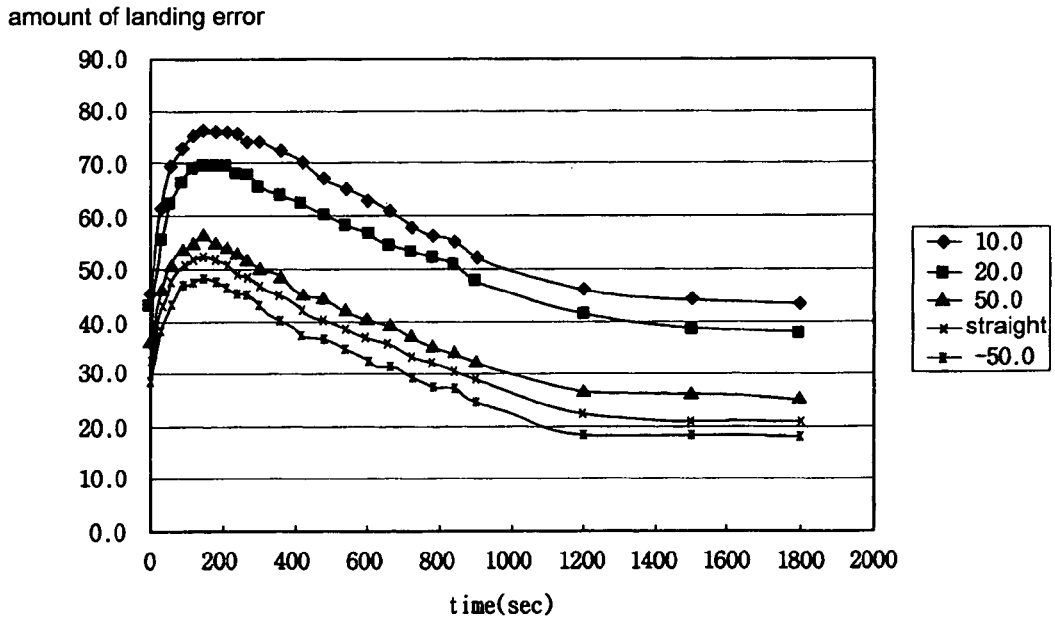
FIG. 7 shows a graph for illustrating the result of Table 1.

Table 1 is the result of the experiment where landing error was measured for various shadow masks having various radius of curvature of corners. FIG. 7 shows a graph for illustrating the result of Table 1.

TABLE 1

| | | Radius of curvature of corner of shadow mask(mm) | | | | |
|---|---|---|---|---|---|---|
| | | | | The present invention | | |
| | | The conventional | | Embodiment 1 | Embodiment 2 | Embodiment 2 |
| Time(sec) | | 10.0 | 20.0 | 50.0 | Straight line | −50.0 |
| 0 | amount | 45.3 | 43.0 | 36.1 | 32.2 | 28.3 |
| 30 | of | 61.8 | 55.4 | 46.5 | 42.5 | 38.1 |
| 60 | landing | 69.4 | 62.6 | 51.0 | 47.3 | 43.3 |
| 90 | error | 73.2 | 66.6 | 53.9 | 50.8 | 46.7 |
| 120 | | 75.6 | 69.2 | 55.1 | 51.7 | 47.3 |
| 150 | | 76.6 | 69.6 | 56.5 | 52.3 | 48.1 |
| 180 | | 76.3 | 69.4 | 55.1 | 51.8 | 47.2 |
| 210 | | 76.3 | 69.6 | 54.3 | 50.5 | 46.5 |
| 240 | | 75.9 | 68.1 | 53.1 | 49.2 | 45.3 |
| 270 | | 74.3 | 67.6 | 51.9 | 48.1 | 44.7 |
| 300 | | 74.3 | 65.6 | 50.0 | 46.7 | 42.6 |
| 360 | | 72.6 | 64.0 | 48.5 | 44.7 | 40.3 |
| 420 | | 70.3 | 62.6 | 45.1 | 41.8 | 37.2 |
| 480 | | 67.2 | 60.1 | 44.5 | 40.3 | 36.3 |
| 540 | | 65.3 | 58.2 | 42.1 | 38.2 | 34.7 |

TABLE 1-continued

| | Radius of curvature of corner of shadow mask(mm) | | | | |
|---|---|---|---|---|---|
| | | | The present invention | | |
| | The conventional | | Embodiment 1 | Embodiment 2 | Embodiment 2 |
| Time(sec) | 10.0 | 20.0 | 50.0 | Straight line | −50.0 |
| 600 | 63.3 | 56.6 | 40.6 | 36.8 | 32.1 |
| 660 | 61.2 | 54.6 | 39.1 | 35.3 | 31.3 |
| 720 | 58.2 | 53.2 | 36.9 | 33.1 | 29.2 |
| 780 | 56.3 | 52.1 | 35.1 | 31.8 | 27.3 |
| 840 | 55.3 | 51.0 | 34.0 | 30.5 | 26.7 |
| 900 | 52.5 | 47.6 | 32.1 | 28.8 | 24.3 |
| 1200 | 46.2 | 41.6 | 26.7 | 22.2 | 18.5 |
| 1500 | 44.3 | 38.4 | 26.1 | 21.1 | 18.3 |
| 1800 | 43.2 | 37.5 | 25.3 | 21.2 | 18.1 |

As shown in Table 1 and FIG. 7, as the radius of curvature of corners of faceplate increases, the effect of the corners on the expansion of the shadow mask decreases. Consequently, non-uniformity of thermal expansion of the shadow mask decreases and, therefore, landing error of the electron beam decreases. According to the result of the experiment shown in Table 1 and FIG. 7, landing error of the electron beam was remarkably decreased when the radius of curvature of at least a corner is the same or larger than 50 mm. Otherwise, when the corner is straight or has negative radius of curvature, landing error was reduced in comparison with the prior art.

By making corners of the faceplate to be flat or concave in comparison with the prior art, it is possible to make the shadow mask to expand more uniformly. Preferably, when radius of curvature of the corners is no smaller than 50 mm, the thermal expansion becomes remarkably uniform.

Even if the shadow mask is made of AK material, landing error is still remarkably reduced in comparison with the prior art.

Figure 8A:
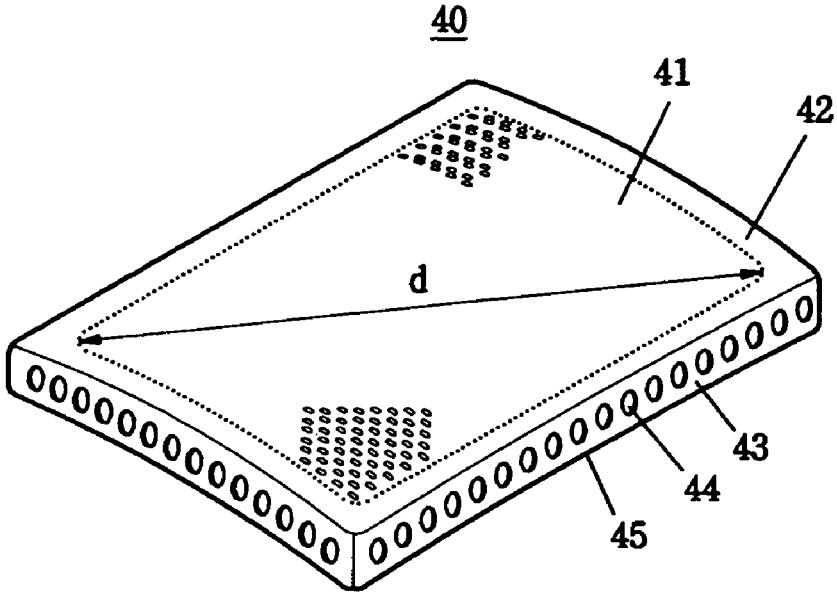
FIGS. 8*a* and 8*b* show a perspective view of the shadow mask in accordance with the present invention.
Figure 8B:
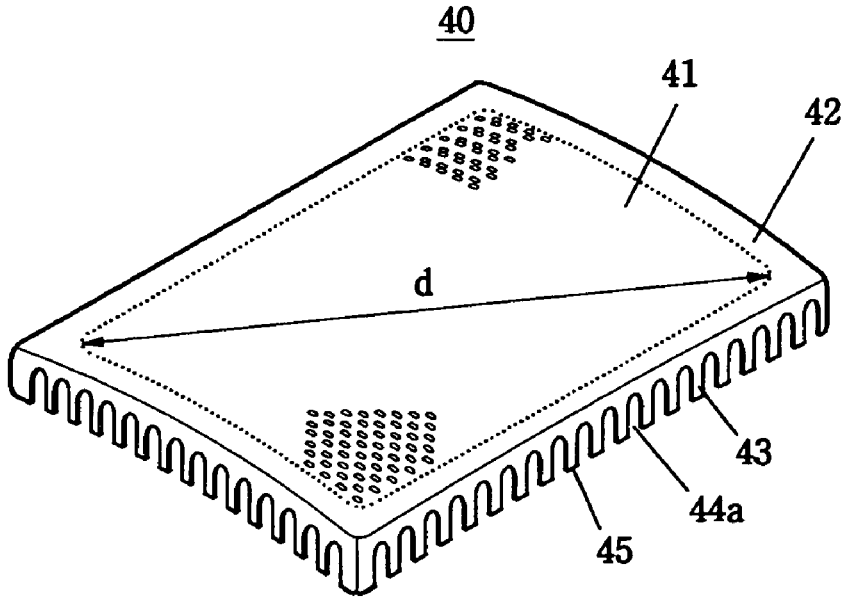

FIGS. 8*a* and 8*b* show a perspective view of the shadow mask in accordance with the present invention. As shown in FIG. 8*a*, holes can be perforated at the skirt portion. With the holes, heat transfer from the shadow mask to the frame can further be reduced. Accordingly, landing error of the electron beams could also be remarkably reduced. The holes may have various shapes, e.g., circular, elliptical, or rectangular shape. As shown in FIG. 8*b*, the holes may be opened to the backward direction from the front face side of the shadow mask. Further, the holes may be perforated at the part of the skirt portion which is opposite to the frame.

According to other modified version of Embodiment 1, by making the part of the skirt portion, which is opposite to the frame, to be as small as possible, heat transfer between the skirt portion and the frame is minimized. Accordingly, non-uniformity of thermal expansion between the central and peripheral portions in the shadow mask is decreased such that landing error of electron beam caused by the non-uniformity of expansion is decreased.

Figure 9:
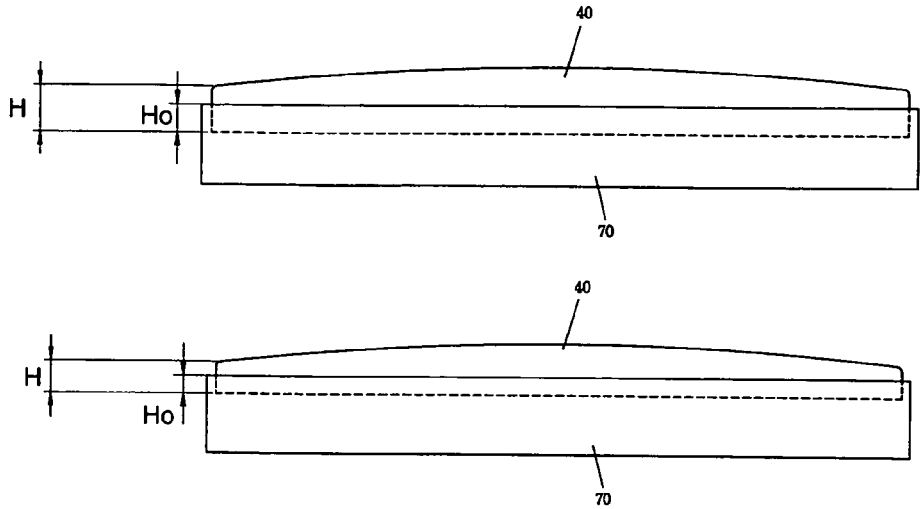
FIG. 9 shows a side view of the mask-frame assembly to illustrate an example of the skirt portions having relatively long and short lengths respectively.

The inventor carried out experiments on the length of the skirt portion to find out adequate size of the skirt portion which makes the area of the part of the skirt portion opposite to the frame to be as small as possible. The length of the overall skirt portion was designed variously. FIG. 9 shows side view of the mask-frame assembly to illustrate an example of the skirt portions having relatively long and short lengths respectively. As shown in FIG. 9, as the length of the skirt portion decreases, the length of the part of the skirt portion which is opposite to the frame decreases accordingly.

Figure 10:
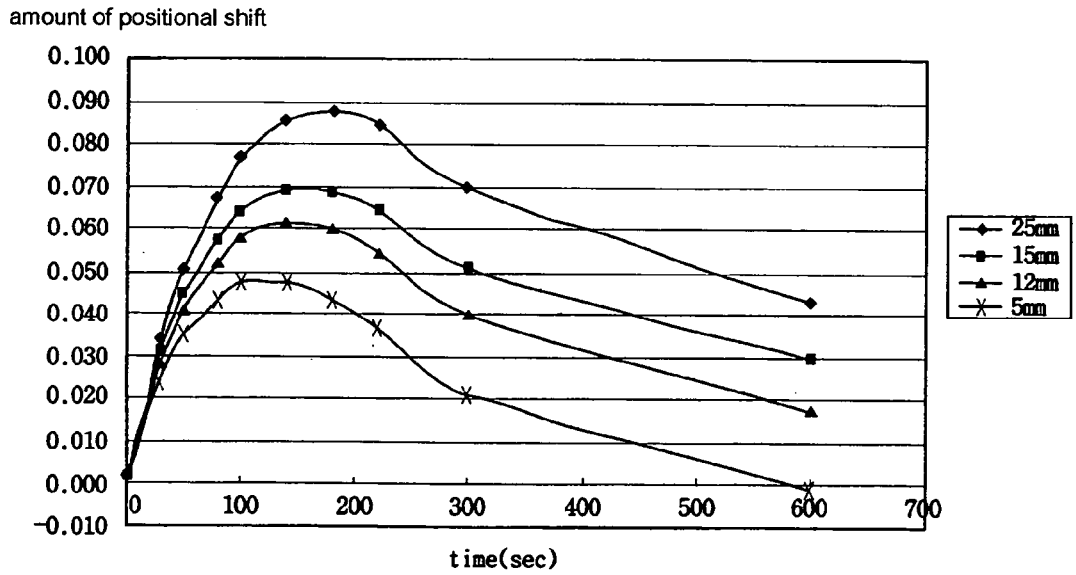
FIG. 10 shows a graph for illustrating the result of Table 2.

Table 2 is the result of an experiment where landing error was measured for various shadow masks having skirt portions of various lengths. FIG. 10 shows a graph for illustrating the result of Table 2.

TABLE 2

| | | Length of skirt portion of shadow mask(mm) | | | | |
|---|---|---|---|---|---|---|
| | | The conventional | | The present invention | | |
| Time(sec) | | 25 | 15 | 12 | 8 | 5 |
| 1 | amount | 0.002 | 0.002 | 0.002 | 0.002 | 0.002 |
| 30 | of | 0.034 | 0.031 | 0.029 | 0.026 | 0.025 |
| 50 | landing | 0.050 | 0.045 | 0.041 | 0.037 | 0.035 |
| 80 | error | 0.067 | 0.058 | 0.053 | 0.046 | 0.044 |
| 100 | | 0.077 | 0.064 | 0.058 | 0.050 | 0.047 |
| 140 | | 0.085 | 0.069 | 0.062 | 0.051 | 0.048 |
| 180 | | 0.087 | 0.069 | 0.060 | 0.047 | 0.044 |
| 220 | | 0.084 | 0.065 | 0.055 | 0.040 | 0.037 |
| 300 | | 0.070 | 0.051 | 0.040 | 0.032 | 0.021 |
| 600 | | 0.043 | 0.029 | 0.017 | 0.008 | −0.001 |

As shown in Table 2 and FIG. 10, as the length of the skirt portion decreases, the length of the part of the skirt portion which is opposite to the frame decreases accordingly. Consequently, heat transfer from the shadow mask to the frame decreases, and, therefore, landing error of the electron beam decreases. According to the result of the experiment shown in Table 2 and FIG. 10, landing error of the electron beam was remarkably decreased when the length of the skirt portion is the same or shorter than 12 mm. When the length of the skirt portion is 12 mm or below, length of the part of the skirt portion which is opposite to the frame becomes 10 mm or below. Consequently, when length of the part of the skirt portion which is opposite to the frame is 10 mm or below, landing error of the electron beam is remarkably reduced.

Figure 11:
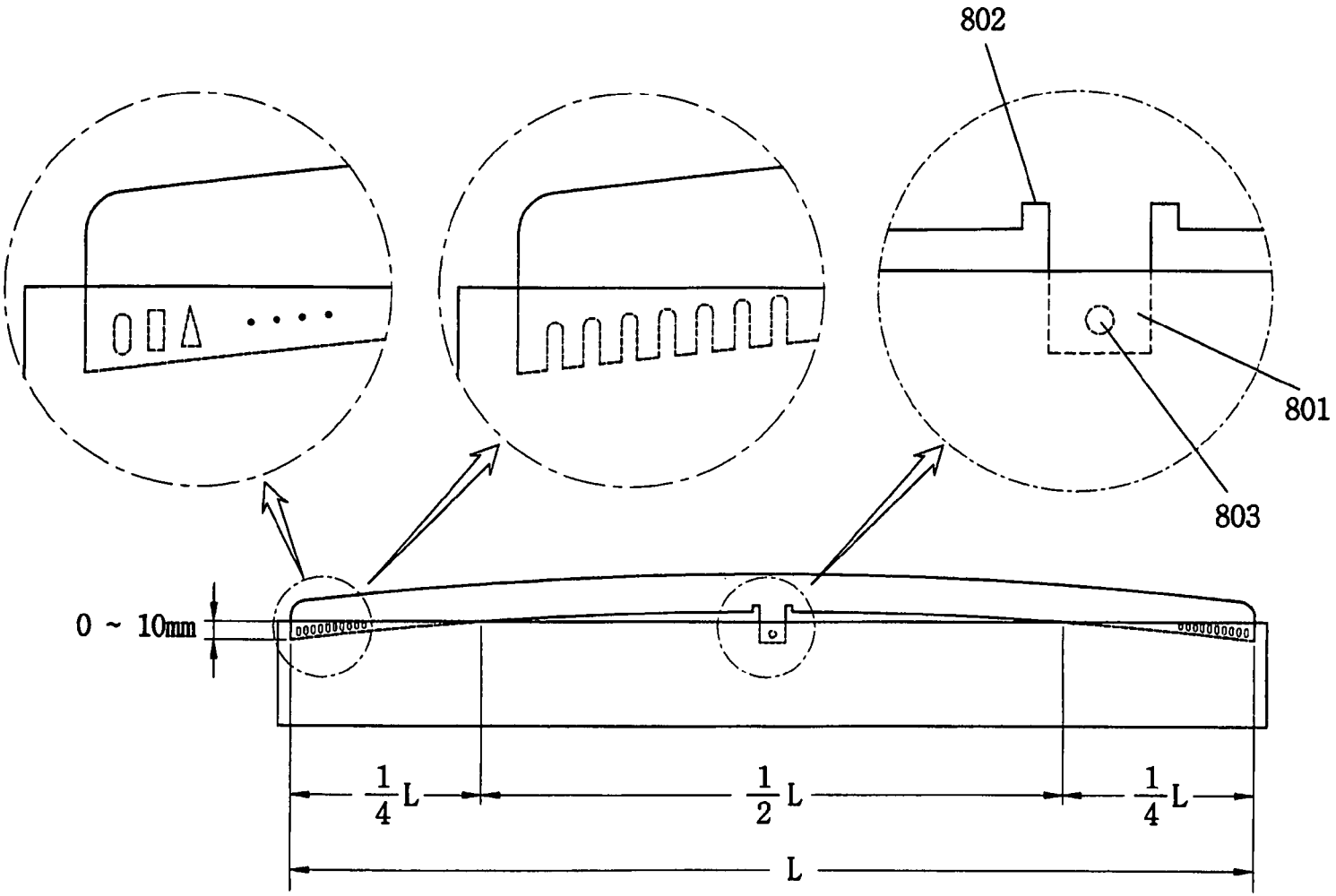
FIG. 11 shows a side view of the shadow mask in accordance with the modified version of Embodiment 1 of the present invention.

FIG. 11 shows a side view of the shadow mask in accordance with the modified version of Embodiment 1 of the present invention. As shown in FIG. 11, the skirt portion may have an extension 801 having welding point 803 to be welded to the frame. This extension may be provided instead of or in addition to welding points at 4 corners of the shadow mask. With the extension 801, it is possible to further reduce length of the part in the skirt portion which is opposite to the frame. Moreover, it is possible to prevent the welding points at four corners of the shadow mask from becoming a binding when the mask expands. Therefore, landing error problem is reduced further.

According to still further modified version of Embodiment 1, at the long side of the rectangular frontface of the shadow mask, central portion of end line of the frame is projected toward the frontface direction more than corresponding central portion of a side of the frontface portion of the shadow mask. This is the case when the outer surface of the panel becomes flat and, therefore, a side of the frontface portion of the shadow mask is located rearer than the end line of the frame.

Further, the every embodiments described hereinabove may be applied to flat type color cathode ray tube where front face surface of panel is substantially flat. Therefore, the effect of the present invention is still effective for the flat type color cathode ray tube.

<Embodiment 2>

According to another aspect of the present invention, a color cathode ray tube comprises a panel on inner surface of which a phosphor screen is formed; a funnel joined to the panel; an electron gun generating electron beams; a shadow mask mounted to the panel, the shadow mask having a faceplate portion and a peripheral skirt portion bent back from the faceplate portion; and a frame joined to said shadow mask; wherein at least a corner of the faceplate portion of said shadow mask includes substantially straight line portion, and gap is provided between a corner of the faceplate portion of said shadow mask and a corresponding corner of said frame.

Figure 12:
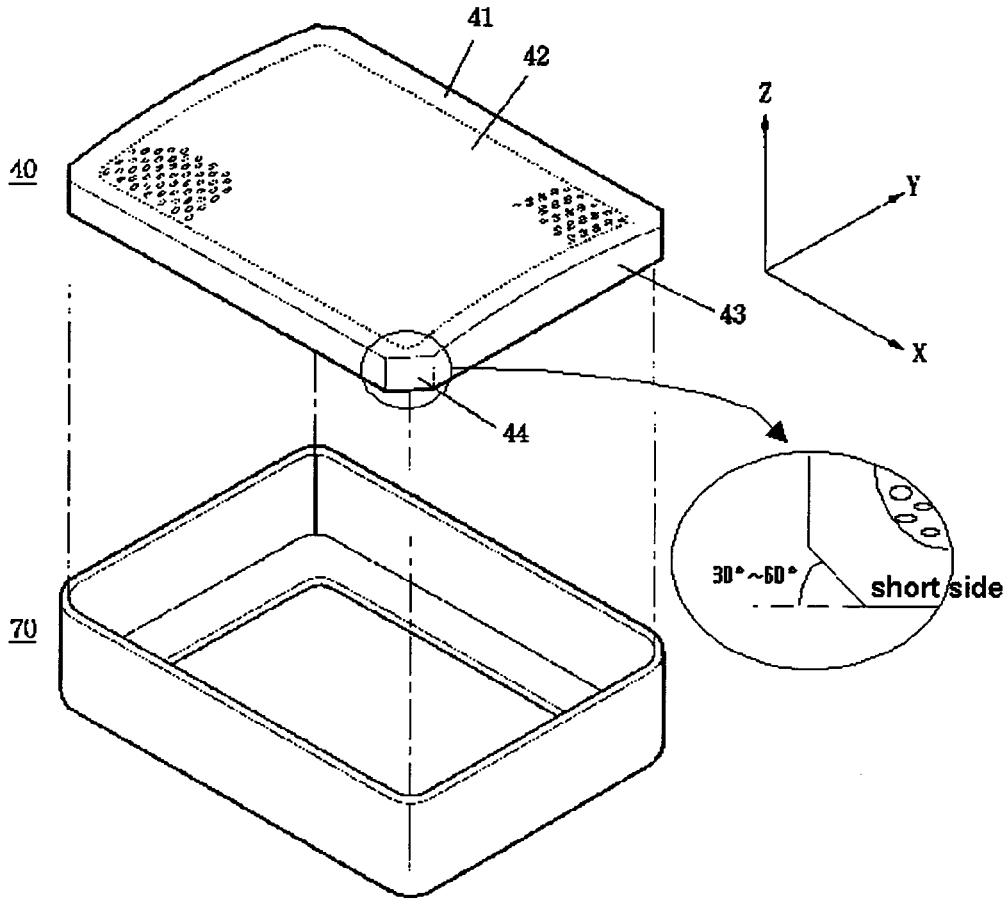
FIG. 12 shows a perspective view of the shadow mask in accordance with Embodiment 2 of the present invention.

FIG. 12 shows a perspective view of the shadow mask in accordance with Embodiment 2 of the present invention. As shown in FIG. 12, the shadow mask in accordance with Embodiment 2 of the present invention comprises a faceplate portion and a peripheral skirt portion 43 bent back from the faceplate portion and extending backward from faceplate portion. The faceplate portion further comprises an apertured portion 42 where minute apertures through which electron beams pass are defined and a non-apertured border portion 41 surrounding the apertured portion 42.

According to Embodiment 2, at least a corner of the faceplate includes substantially straight line portion.

As shown in Table 1 and FIG. 7, as the corners of faceplate includes substantially straight line portion, the effect of the corners on the expansion of the shadow mask decreases. Consequently, non-uniformity of thermal expansion of the shadow mask decreases and, therefore, landing error of the electron beam decreases. According to the result of the experiment shown in Table 1 and FIG. 7, landing error of the electron beam was remarkably decreased when the corners of faceplate includes substantially straight line portion.

By making corners of the faceplate to be dull or concave in comparison with the prior art, it is possible to make the shadow mask to expand more uniformly.

Preferably, when the angle between major side or minor side of the faceplate and the straight line portion of the corners of the faceplate is in the range of 30° to 60°, the thermal expansion becomes remarkably uniform.

For Embodiment 2, the modifications made to Embodiment 1 as described above may also be applied. Such modifications includes: providing holes at the skirt portion; curving the end line of the skirt portion; limiting area of the part in the skirt portion which is not opposite to the frame; limiting length of the part of the skirt portion that is opposite to the frame; providing some extensions. Detailed description of such modifications should be referred to that of Embodiment 1.

Embodiment 2 may further include such modifications as the use of AK material for the shadow mask; the location of the end line of the frame; and making the front face of panel to be substantially flat.

<Embodiment 3>

According to other aspect of the present invention, a color cathode ray tube comprises a panel on inner surface of which a phosphor screen is formed; a funnel joined to the panel; an electron gun generating electron beams; a shadow mask mounted to the panel, the shadow mask having a faceplate portion and a peripheral skirt portion bent back from the faceplate portion; and a frame joined to said shadow mask; wherein at least a corner of the faceplate portion includes a concave portion, and gap is provided between a corner of the faceplate portion of said shadow mask and a corresponding corner of said frame.

Figure 13:
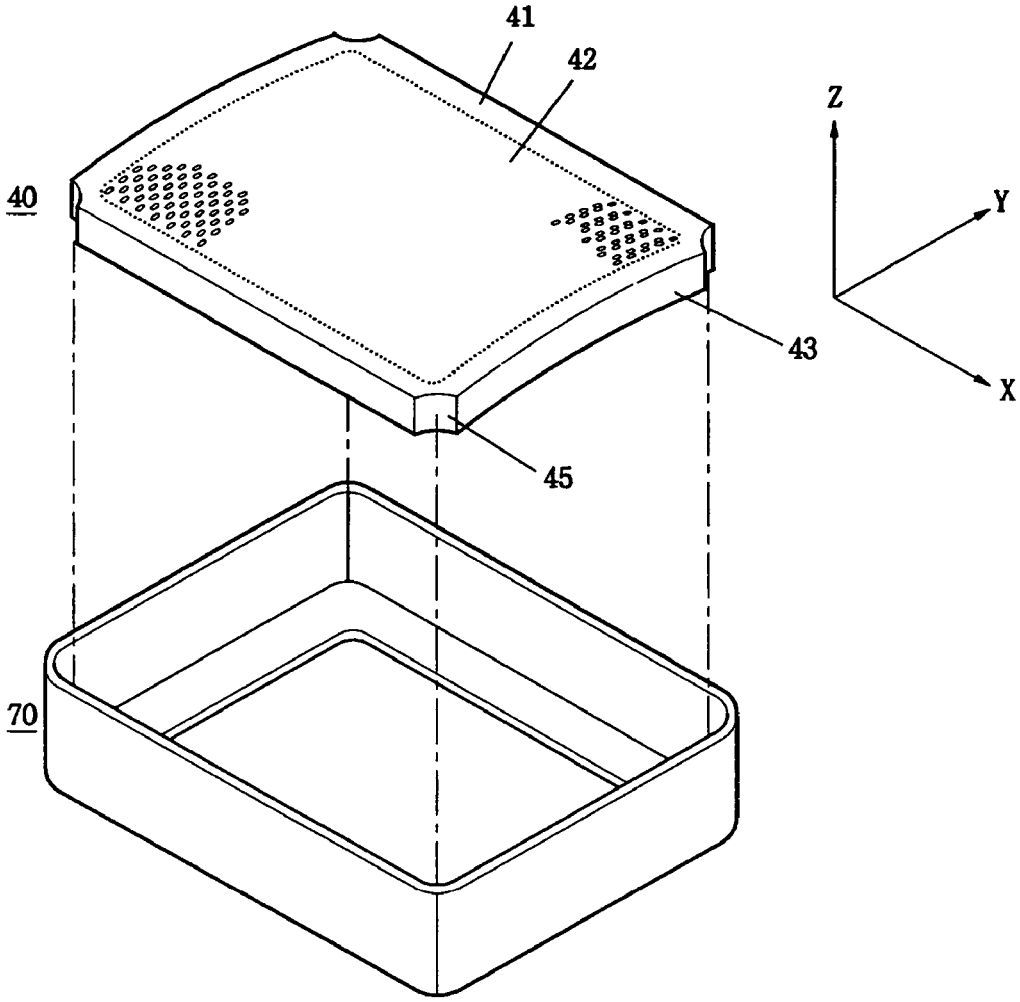
FIG. 13 shows a perspective view of the shadow mask in accordance with Embodiment 3 of the present invention.

FIG. 13 shows a perspective view of the shadow mask in accordance with Embodiment 3 of the present invention.

As shown in FIG. 13, the shadow mask in accordance with Embodiment 2 of the present invention comprises a faceplate portion and a peripheral skirt portion 43 bent back from the faceplate portion and extending backward from faceplate portion. The faceplate portion further comprises an apertured portion 42 where minute apertures through which electron beams pass are defined and a non-apertured border portion 41 surrounding the apertured portion 42.

According to Embodiment 3, at least a corner of the faceplate of the shadow mask includes concave portion.

Figure 6:
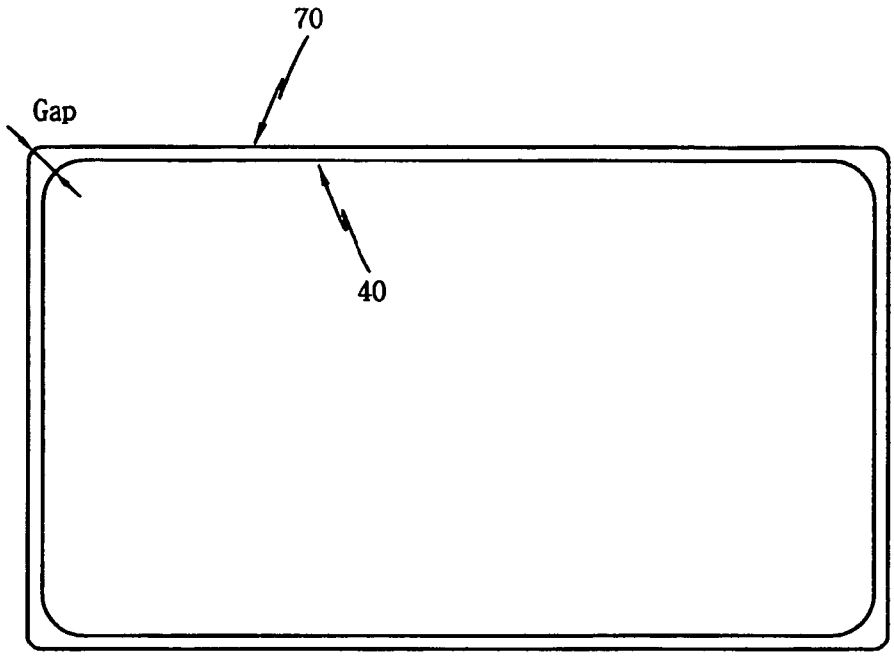
FIG. 6 shows a plane view of the mask-frame assembly in accordance with the present invention viewing from the faceplate side of the shadow mask.

As shown in Table 1 and FIG. 7, as the corners of faceplate includes concave portion, the effect of the corners on the expansion of the shadow mask decreases. Consequently, non-uniformity of thermal expansion of the shadow mask decreases and, therefore, landing error of the electron beam decreases. According to the result of the experiment shown in Table 1 and FIG. 6, landing error of the electron beam was remarkably decreased when the corners of faceplate includes concave portion.

By making corners of the faceplate to be flat or concave in comparison with the prior art, it is possible to make the shadow mask to expand more uniformly.

For Embodiment 3, the modifications made to Embodiment 1 as described above may also be applied. Such modifications includes: providing holes at the skirt portion; curving the end line of the skirt portion; limiting area of the part in the skirt portion which is not opposite to the frame; limiting length of the part of the skirt portion that is opposite to the frame; providing some extensions. Detailed description of such modifications should be referred to that of Embodiment 1.

Embodiment 3 may further include such modifications as the use of AK material for the shadow mask; the location of the end line of the frame; and making the front face of panel to be substantially flat.

INDUSTRIAL APPLICABILITY

As described hereinabove, the present invention may accomplish the effect that landing error of electron beam, which is caused by non-uniform thermal expansion of the shadow mask, is reduced.

Further, according to the present invention, AK material may be used instead of invar material. Since AK material is not expensive in comparison with invar material, overall cost for making a shadow mask is reduced.

The invention claimed is:

1. A color cathode ray tube comprising:

a panel on an inner surface of which a phosphor screen is formed;

a funnel joined to the panel;

an electron gun generating electron beams;

a shadow mask mounted to the panel, the shadow mask having a faceplate portion and a peripheral skirt portion bent back from the faceplate portion and extending a specific length from the faceplate portion; and a frame joined to said shadow mask;

wherein a radius of curvature of at least a corner of the peripheral skirt portion of the faceplate portion of said shadow mask is not smaller than 50 mm, the corner of the peripheral skirt portion of the faceplate portion includes a convex portion, and a gap with a substantially constant distance is provided between a corner of the faceplate portion of said shadow mask and a corresponding corner of said frame along substantially the entire specific length of the peripheral skirt portion.

2. The color cathode ray tube of claim 1, wherein aluminum-killed steel material is used for said shadow mask.

3. The color cathode ray tube of claim 1, wherein a plurality of holes are perforated at said skirt portion.

4. The color cathode ray tube of claim 1, wherein a portion of said skirt portion is opposite to said frame, and a height of the portion opposite to said frame is 10 mm or below.

5. The color cathode ray tube of claim 1, wherein said skirt portion has an extension, and a portion of the extension is joined to said frame.

6. The color cathode ray tube of claim 1, wherein a central portion of an end line of said frame is projected toward the frontface direction more than a corresponding central portion of a side of the frontface portion of said shadow mask.

7. The color cathode ray tube of claim 6, wherein a central portion of an end line of long sides of said frame is projected toward the frontface direction more than a corresponding central portion of a side of the frontface portion of said shadow mask.

8. The color cathode ray tube of claim 1, wherein a front face surface of said panel is substantially flat.

9. A color cathode ray tube comprising:

a panel on an inner surface of which a phosphor screen is formed;

a funnel joined to the panel;

an electron gun generating electron beams;

a shadow mask mounted to the panel, the shadow mask having a faceplate portion and a peripheral skirt portion bent back from the faceplate portion and extending a specific length from the faceplate portion; and a frame joined to said shadow mask;

wherein at least a corner of the peripheral skirt portion of the faceplate portion of said shadow mask includes a substantially straight line portion with an infinite radius of curvature, and a gap with a substantially constant distance is provided between the corner of the faceplate portion of said shadow mask and a corresponding corner of said frame along substantially the entire specific length of the peripheral skirt portion; and wherein a portion of said skirt portion is opposite to said frame, and the height of the portion opposite to said frame is 10 mm or below.

10. The color cathode ray tube of claim 9, wherein an angle between a side of the faceplate portion and the substantially straight line portion of the corner of the faceplate portion is in a range of 30° to 60°.

11. The color cathode ray tube of claim 9, wherein said shadow mask is made of aluminum-killed steel material.

12. The color cathode ray tube of claim 9, wherein a plurality of holes are perforated at said skirt portion.

13. The color cathode ray tube of claim 9, wherein said skirt portion has an extension, and a portion of the extension is joined to said frame.

14. The color cathode ray tube of claim 9, wherein a central portion of an end line of said frame is projected toward the frontface direction more than a corresponding central portion of a side of the frontface portion of said shadow mask.

15. The color cathode ray tube of claim 14, wherein a central portion of an end line of long sides of said frame is projected toward the frontface direction more than a corresponding central portion of a side of the frontface portion of said shadow mask.

16. The color cathode ray tube of claim 9, wherein a front face surface of said panel is substantially flat.

17. A color cathode ray tube comprising:

a panel on an inner surface of which a phosphor screen is formed;

a funnel joined to the panel;

an electron gun generating electron beams;

a shadow mask mounted to the panel, the shadow mask having a faceplate portion and a peripheral skirt portion bent back from the faceplate portion and extending a specific length from the faceplate portion; and a frame joined to said shadow mask; wherein at least an entire corner of the peripheral skirt portion of the faceplate includes a concave portion with a negative radius of curvature, and a gap with a substantially constant distance is provided between the corner of the faceplate portion of said shadow mask and a corresponding corner of said frame along substantially the entire specific length of the peripheral skirt portion.

18. The color cathode ray tube of claim 17, wherein said shadow mask is made of aluminum-killed steel material.

19. The color cathode ray tube of claim 17, wherein a plurality of holes are perforated at said skirt portion.

20. The color cathode ray tube of claim 17, wherein a portion of said skirt portion is opposite to said frame, and a height of the portion opposite to said frame is 10 mm or below.

21. The color cathode ray tube of claim 17, wherein said skirt portion has an extension, and a portion of the extension is joined to said frame.

22. The color cathode ray tube of claim 17, wherein a central portion of an end line of said frame is projected toward the frontface direction more than a corresponding central portion of a side of the frontface portion of said shadow mask.

23. The color cathode ray tube of claim 22, wherein a central portion of an end line of long sides of said frame is projected toward the frontface direction more than a corresponding central portion of a side of the frontface portion of said shadow mask.

24. The color cathode ray tube of claim 17, wherein an outer surface of said panel is substantially flat.

* * * * *